United States Patent [19]

Takafuji

[11] Patent Number: 4,793,654

[45] Date of Patent: Dec. 27, 1988

[54] CHAIR WITH HEIGHT-ADJUSTABLE SEAT

[76] Inventor: Hirosuke Takafuji, 5-19, Obatsu Higashi 3-chome, Higashiosaka-shi, Osaka-fu, Japan

[21] Appl. No.: 12,865

[22] Filed: Feb. 9, 1987

[51] Int. Cl.[4] ..... A47C 5/10

[52] U.S. Cl. ..... 297/338; 297/23; 297/55; 297/331

[58] Field of Search ..... 297/334–336, 297/338, 331, 437, 168, 155, 345, 377, 23, 57; 108/117

[56] References Cited

U.S. PATENT DOCUMENTS

| | | | |
|---|---|---|---|
| 1,039,647 | 9/1912 | Carter | 297/338 X |
| 2,267,963 | 12/1941 | White et al. | 297/23 |
| 2,637,371 | 5/1953 | Boutin | 297/345 |
| 2,843,182 | 7/1958 | Stallard | 297/338 |
| 4,148,523 | 4/1979 | Brand et al. | 297/55 |

FOREIGN PATENT DOCUMENTS

| | | | |
|---|---|---|---|
| 848402 | 7/1949 | Fed. Rep. of Germany | 297/345 |
| 2548217 | 12/1977 | Fed. Rep. of Germany | 297/331 |
| 8458838 | 1/1984 | Japan . | |
| 1428977 | 3/1976 | United Kingdom | 297/331 |
| 2087228 | 5/1982 | United Kingdom | 297/345 |

*Primary Examiner*—Kenneth J. Dorner

*Assistant Examiner*—Laurie K. Cranmer

*Attorney, Agent, or Firm*—Browdy and Neimark

[57] ABSTRACT

A chair with continuously height adjustable seat, comprising a frame having a pair of guide portions and a seat movable along the guide portions and capable of being fixed to the guide portions.

The frame comprises an outside frame and an inside frame both of which are inverse-U shaped pipe frames, and parallel portions of their both sides serve as the above guide portions.

The seat has a pair of support members of which rear portions are inserted in the gaps between the outside frame and inside frame, and each rear portion has a pair of rear stoppers having rubber-made covers and a pair of front stoppers, so that those stoppers securely grip the pipes of guide portions when user sits on the seat.

The pipes in the guide portion have oval cross section longer in lateral direction.

Clamping force of the stoppers is improved and right and left side stopper's group are balanced in clamping force.

In preferable case, each rear, portion has a slot for receiving a engaging member provided in the gap of guide portion so that the seat can be securely held in the folded state.

1 Claim, 6 Drawing Sheets

CHAIR WITH HEIGHT-ADJUSTABLE SEAT

BACKGROUND OF THE INVENTION

The present invention relates to a chair with a height-adjustable seat, and more particularly, to a chair having an improved mechanism for fastening the seat to a pipe frame.

The inventor has proposed, in Japanese Utility Model Application No. 58838/1984, a chair with a height-adjustable seat, comprising a frame having right and left guides in a pair extending in the vertical, but slightly inclined direction at its both side portions, and a seat movable along the guides and capable of being fixed at any required position for use on the guides.

Each guide of the chair is formed of a pair of pipes or bars, which also serves as a pipe frame of the chair, and each pipe or bar has a circular cross section. The pipes or bars of each guide are arranged at left and right positions in parallel with each other so as to form a longitudinal gap therebetween. Then, the chair has two gaps which are also parallel with each other at both sides thereof.

The seat mentioned above has two supports or brackets having a rear portion freely inserted through the gaps, respectively, and a set of rod-like rear and front stoppers laterally fixed to the rear portions of the supports.

Each stopper comprises a middle portion extending between the supports and outside portions projecting outwardly from the supports. The rear stopper is fixed on the most rear ends of the supports. The front stopper is arranged in parallel with the rear stopper so that the front stopper abuts against the front surface of the guide while the rear stopper abuts against back surface of the guides to grip the guide when the seat is set for sitting.

Further the front stopper is situated lower than the rear stopper, when the seat is set. The whole outer surface of the stoppers are each made of a cylindrical rubber-like elastomeric cover. The covers have a cylindrical shape and are fixed on a core rod so as not to rotate around their axes.

In the above-mentioned chair, the seat is freely movable when the front end portion is taken up to release stopper's gripping force. The user can easily slide the seat upwardly or downwardly, for instance, by gripping the front end of seat and the middle portion of the rear stopper.

When a suitable height is selected, the seat is re-set to a substantially horizontal posture, and then, the front and rear stoppers are abutted against the guide portions, respectively, to grip then. Accordingly, a user's weight is supported by a frictional force between the stoppers and the guide portions. The frictional force increases due to the inclining torque in the front-down direction applied by the user's weight.

However, in the conventional chair, each contacting area between the stopper and the guide portion is narrow, since both stopper and guide portion have cylindrical shapes. That is to say, the guide portion is made of a pair of pipes or bars each having circular cross section since they are also used as a frame of chair as mentioned above. Therefore, there is a disadvantage that stopper's gripping force is not sufficient.

Further, since the middle portions of the stoppers are horizontally bridged between two supports of the seat, rigidity of the outside portions abutting against the outside frame pipes and that of inside portions abutting against the inside frame pipes are different from each other. Therefore, the function as of the as stoppers is not sufficiently effected.

In addition, if the seat is set in a slightly inclined posture in a right and left direction, only one side of the guide portions, i.e. only right or left guide portion is securely caught by the corresponding surfaces of the stoppers, while the other side of the guide portion is not sufficiently caught.

Under such a situation, the gripping forces of left side and right side cannot be in well balance. Accordingly, when a user sits on the seat, one of suppots may occasionally slip down for a small amount. Another disadvantage of the conventional chair is that though the seat can folded upwardly, the seat cannot be securely fixed to the frame when the seat is folded. Therefore, it is inconvenient to carry the folded chair.

One object of the present invention is to provide a chair with a height adjustable seat in which the stopper's function is improved.

Another object of the present invention is to provide a chair in which the seat can be securely fixed to the frame when the seat is folded.

SUMMARY OF THE INVENTION

In accordance with the present invention, a chair is provided comprising a frame having guide portions extending vertical or inclined in a certain angular direction at left and right sides thereof, and a seat capable of moving along the guide portions. Each guide portion comprises a pair of pipes or bars arranged parallel with each other in left and right direction so as to form a longitudinal gap. The pipes or bars have a substantially oval-shaped cross section with longer width in the right to left direction than the front to rear direction. The seat has right and left support members, each rear portion of which is inserted through the gap. The rear portion has a pair of rear stoppers laterally projecting from both sides of the rear portion at the rear end thereof, and a pair of front stoppers laterally projecting from both sides of the rear portion at a front and lower position with reference to the rear stoppers when the seat is set for sitting.

Hereinafter, preferable embodiments of the present invention are explained with reference to the accompanyng drawings.

DETAILED DESCRIPTION OF THE INVENTION

Figure 1:
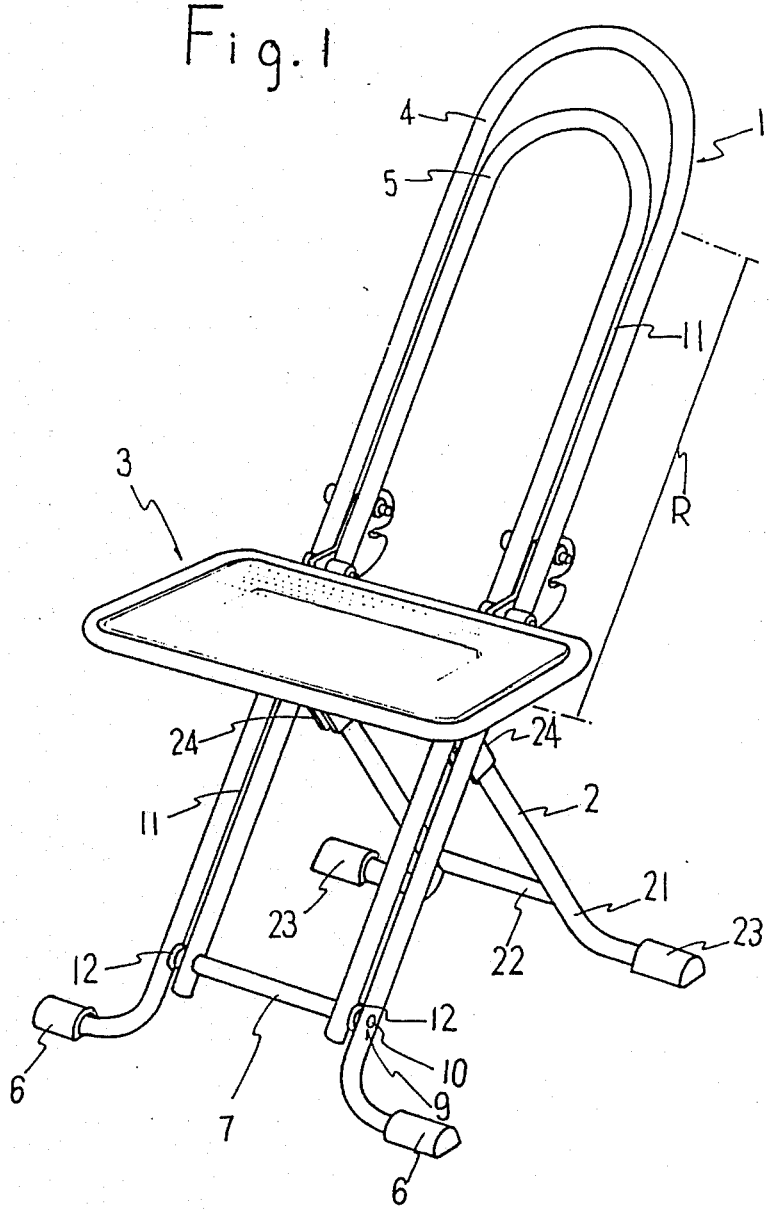
FIG. 1 is a perspective view showing an embodiment of the chair of the present invention.

As shown in FIG. 1, the chair of the embodiment according to the present invention fundamentally comprises a main frame 1, a rear leg 2 and a seat 3.

The main frame 1 comprises an outside frame 4 and an inside frame 5. The outside frame 4 has an inverse-U-shaped form. The lower portions of the outside frame 4 serves as front legs and the bottoms thereof are bent outwardly as feet 6.

The inside frame 5 is also has an inverse-U-shaped form and its bottom ends are bridged with a lateral member 7 made of a pipe or bar.

Those frames 4 and 5 are manufactured by bending pipes or bars, e.g. steel pipes or another metal pipes or bars, having generally circular profiles in cross section. In another embodiment, those frames may have oblong rectangular shape or the like.

The inside frame 5 is arranged inside the outside frame 4, on the same plane as the outside frame 4. Those frames 4 and 5 are fixed at middle portions (upper connecting portion 8) and at bottom portions (lower connecting portion 9) with each other by means of pins 10, rivets, or the like so as to form longitudinal gaps 11 at both sides thereof. At those connecting portions 8,9, ring-shaped spacers 12 or washers are provided around the pins 10 to ensure the two gaps 11.

Figure 4:
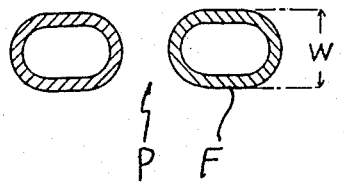
FIGS. 4 and 5 are sectional views showing embodiments of the pipe in the present invention.
Figure 5:
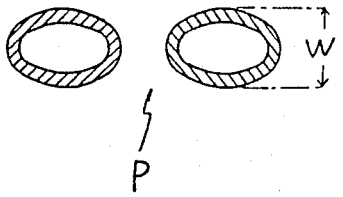

In a region R where four pipes are arranged parallel with each other, above the upper connecting portions 8, each pipe has an oval cross section of which right to left width is larger than the front to rear width as shown in FIGS. 4 and 5, for example. In this specification, the word oval includes a circle having parallel portions F (see FIG. 4). Such shape can be obtained by, for example, slightly stamping the pipe in front to rear direction.

That is to say, in that region R, the left side portions of the outside frame 4 and inside frame 5 serve as a left guide portion having a left side gap 11 between them, and the right side portions of the frames 4 and 5 serve as a right guide portion having a right side gap 11.

The above mentioned rear leg 2 has U-shaped form and is also made of a pipe or bar. The upper ends of the rear leg 2 are pivotally connected with the upper connecting portions 8 of the inside frame 5 by utilizing the above mentioned pins 10.

In more detail, the rear leg 2 comprising two L-shaped vertical members 21 and lateral member 22 which are made of pipes, bars, or the like, and are integrated into one body by welding, or the like.

Each vertical member 21 has an outwardly curved portion as a foot 23.

Figure 2:
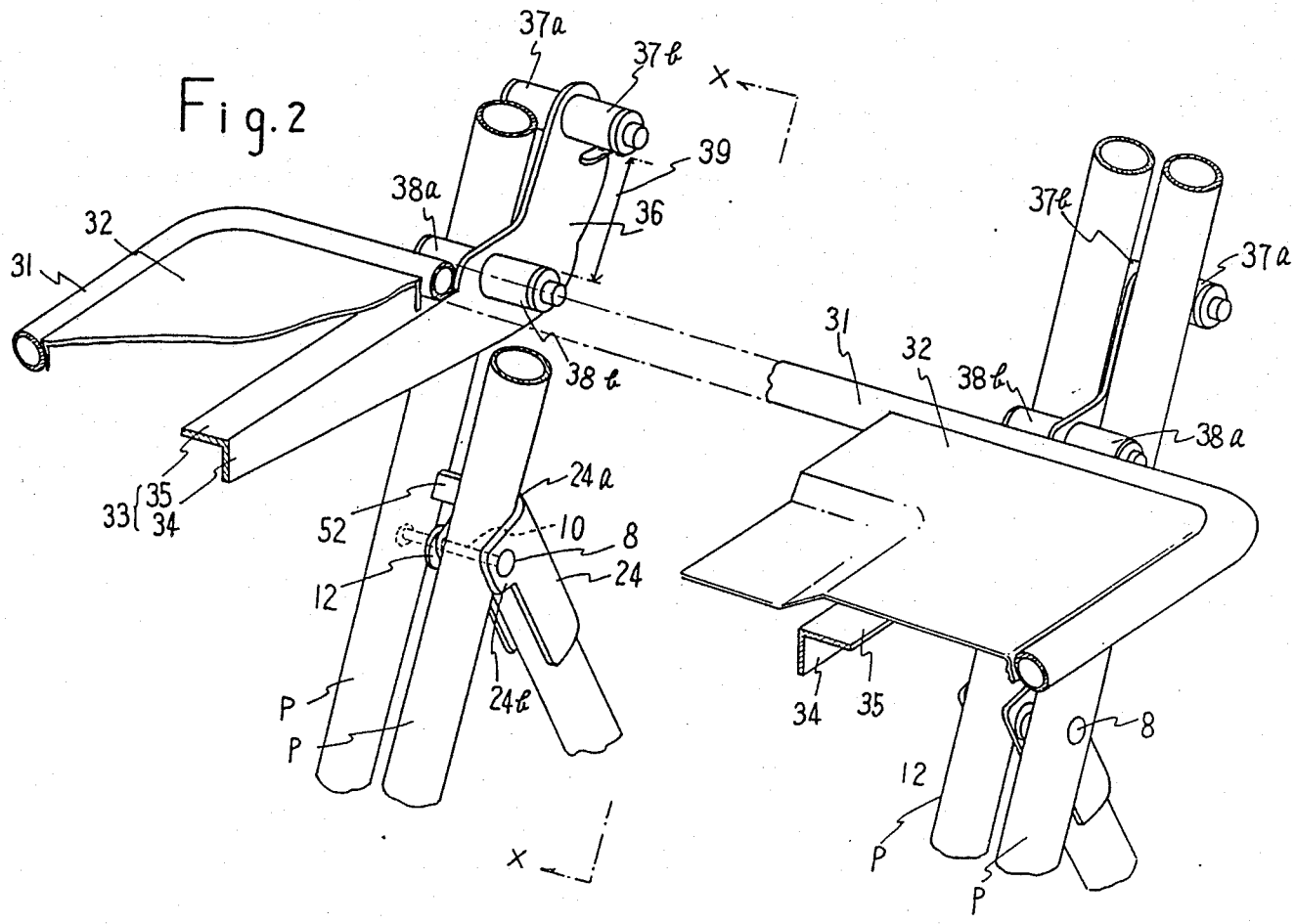
FIG. 2 is an enlarged perspective view of the important portion of the chair of FIG. 1.

As shown in FIG. 2, the top portion of the vertical member 21 is inserted into and fixed to a connecting member 24 having U-shaped cross section, and the inside frame 5 is inserted between both side walls **24*b* of the connecting member 24. The upper edge 24*a* of the connecting member 24 serves as a stopper when the rear leg 2** is unfolded.

Figure 3:
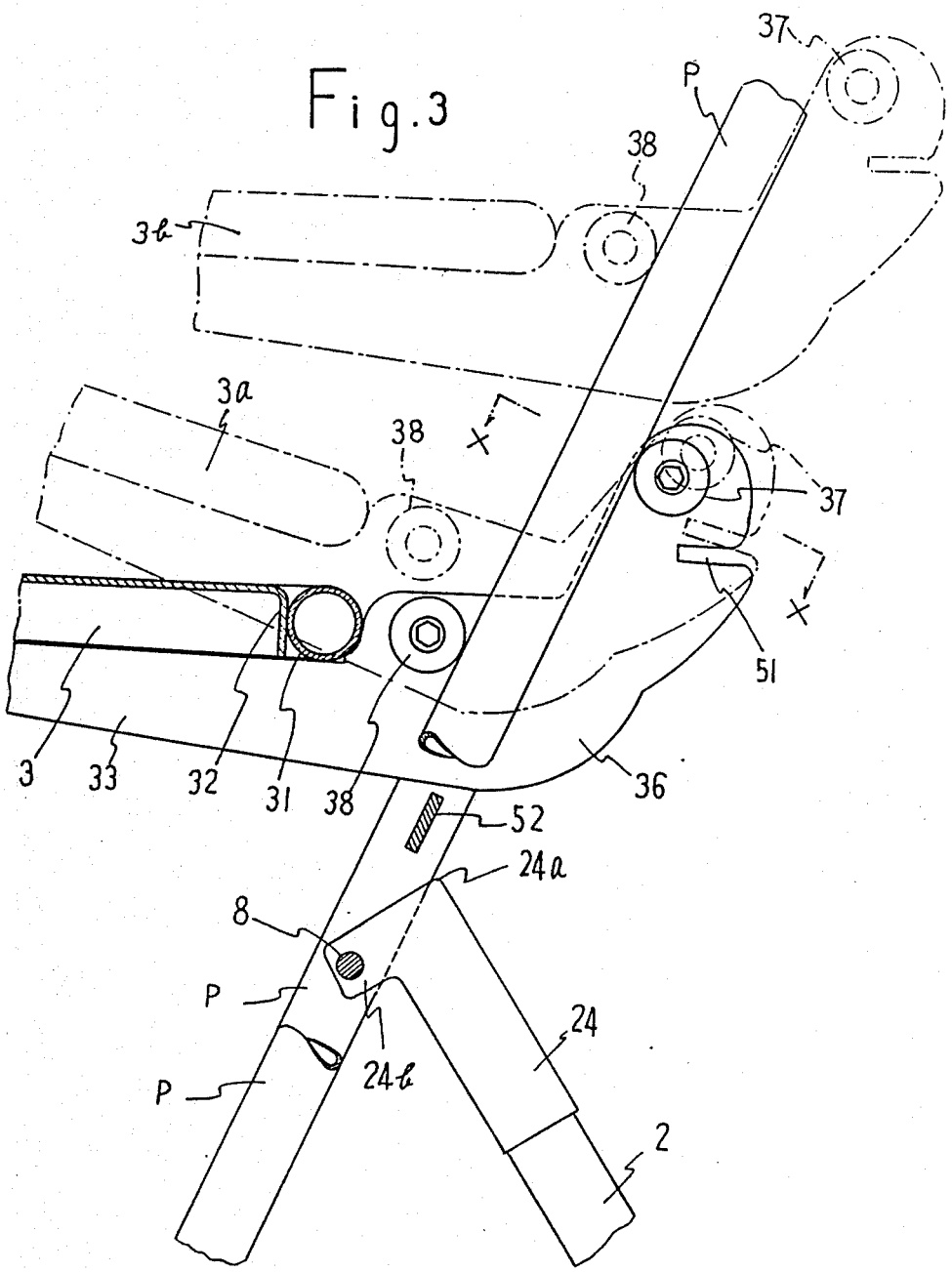
FIG. 3 is a sectional view along X—X in FIG. 2.

Referring to FIGS. 1 to 3, the above mentioned seat 3 comprises a rectangular pipe frame 31, a sheet metal 32 fixed inside the pipe frame 31 and support members 33 which are welded under the pipe frame 31. The sheet metal 32 is made of, for example, perforated steel sheet.

Each support member 33 comprises a vertical plate 34 and a horizontal plate 35 welded to each other. The vertical plate 34 has a rear portion 36 upwardly curved. The rear portion 36 is inserted through the gap 11 of the above-mentioned guide portion.

On the rear portion 36, rear stoppers 37 and front stoppers 38 are fixed perpendicularly with the rear portion 36. The rear stoppers 37 are situated behind the main frame 1, and the front stoppers 38 are situated in front of or before the main frame 1. The rear stoppers 37 and front stoppers 38 are arranged parallel with each other so as to from a gap 39.

The gap 39 is wider than the front-to-rear width of the pipe in the guide portion. The rear stoppers 37 are situated at an upper position with respect to the front stoppers 38 when the seat is almost horizontally set in the guide portion. That is to say, the gap 39 has such dimension and position that the seat 3 is almost horizontally held when the seat 3 is set as shown in FIG. 3.

Figure 6:
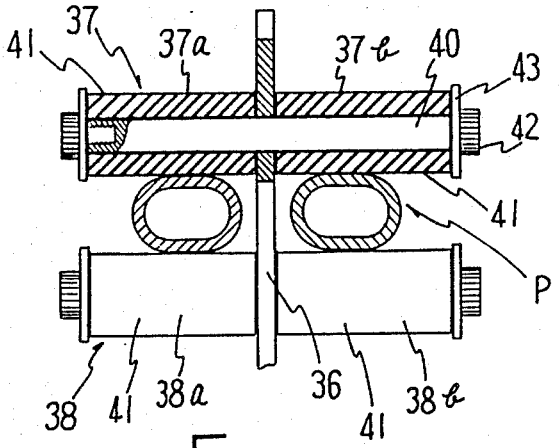
FIG. 6 is a sectional view along line X—X in FIG. 3 when no load is applied on the seat.

As shown in FIG. 6, each stopper 37, 38 comprises a rod 40 inserted thrugh a hole provided in the rear portion 36. Rods 40 are fixed to the rear portion 36 and to the cylindrical elastomeric over members 41. The cover members 41 are put on the rod 40 and securely held by screws 42 and washers 43.

The cover member 41 is generally made of rubber-like resilient material, such as polyulethan, synthetic rubber, natural rubber, another synthetic resin, or the like. The material preferably has high strength, resilience, and friction coefficient.

The rod 40 has a circular section or polygonal section, and the cover member 41 has the corresponding shape through-hole. When the contacting surface of the cover member 41 becomes worn, a new surface can be used by reinserting the cover member 41 after rotating by a certain angle.

Hereinafter, how to use the above mentioned chair and the function of the height-adjusting mechanism will be explained.

When the height of the seat 3 is required to change, a front end of the seat 3 is slightly lifed up as shown in FIG. 3 by imaginary lines **3*a***.

Under this situation, since the gap 39 is larger than the thickness of the pipe in the guide portion, the seat **3*a*** can be freely moved an up and down direction while keeping the inclined posture.

At a required height, by returning the posture of the seat 3 to the original horizontal state again, all stoppers 37 and 38 are abutted against the pipes in the guide portions, and the seat 3 is fixed in this position.

Figure 7:
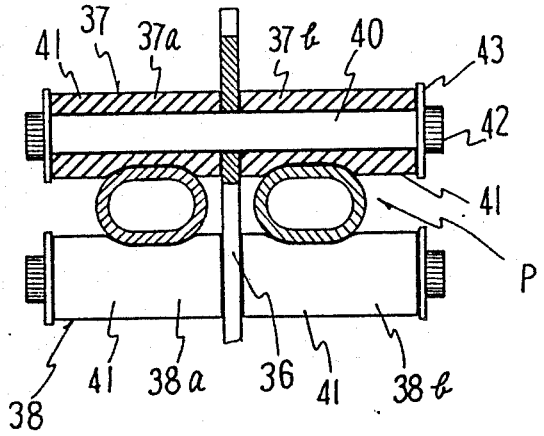
FIG. 7 is a sectional view along line X—X in FIG. 3 when a load is applied on the seat.

Thus, the height adjustment of the seat 3 can be easily and continuously, that is, not in a steplike manner performed. When a user sits on the seat 3 after the adjustment is completed, the stoppers 37, 38 grasp the pipes more tightly, and therefore, the cover members 41 are resiliently deformed, subject to the oval outline of the pipes to give further wider contacting areas, as shown in FIG. 7.

Accordingly, the user's weight is securely supported with sufficient frictional force between the stoppers 37,38 (via cover members 41) and the pipes of guide portions. In addition, the user feels comfortable due to a cusion effect of the elastomeric cover members 41.

In the above mentioned stoppers 37, 38, outside stopper **37*a*(38*a*) and inside stopper 37*b* (38*b*) are symmetrical with respect to the rear portion 36 of the support member 33**, and the outside pipe and the inside pipe are evenly tightened.

Further, with regard to the center line of the chair, the left side stopper's group and the right side stopper's group achieve the stopping function independently from each other, since the inside stoppers (37*b* and 38*b*) are not continuous with each other, but are separated.

Therefore, even if the seat 3 is slightly inclined in the left to right direction, i.e. even if one of support member is slightly higher than the other support member, both stopper groups individually securely grasp the frames 4 and 5 with almost equal force.

Accordingly, in the above mentioned chair, the disadvantage of the conventional chair that only one side stopper groups effects the stoper function strongly when the seat 3 is inclined in the right to left direction and then the seat 3 slightly slips down, is overcome.

Next, an example of folding-unfolding mechanism and functions will be described hereinafter.

In each gap 11 provided on both side portions of the main frame and at a position over connecting member 24 a bar-like engaging member 52 is provided. Each rear portion 36 of the support member 33 has a slot 51 beneath the rear stopper 37. The periphery of the slot 51 is engageable with the engaging member 52 when the seat 3 is turned along the main frame.

Figure 9:
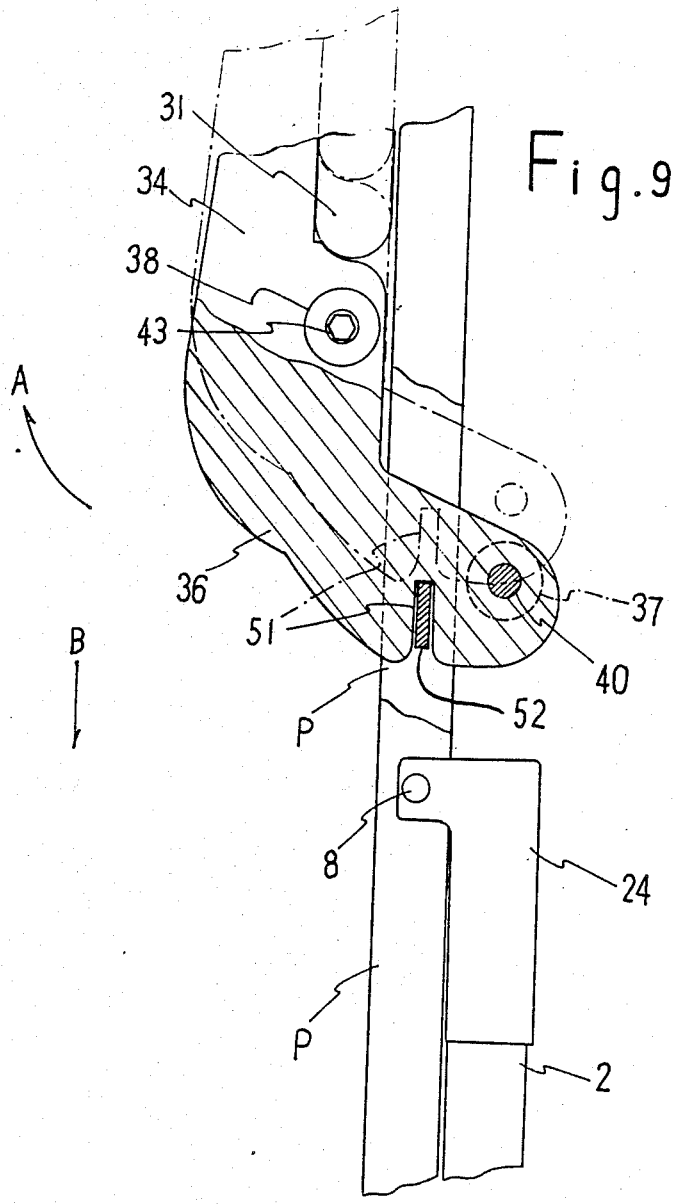
FIG. 9 is a sectional view along line Y—Y in FIG. 8.

When the chair is folded, at first, the seat 3 is turned over toward the main frame 1 by raising the front end of the seats, as shown by arrow A in FIG. 9, to abut against the main frame 1.

Sequentially the seat 3 is slid downward to engage the slots 51 of the rear portion 36 with the engaging members 52. Then, the seat 3 is securely held by main frame 1 (See FIG. 7). The engaging member 52 is a flat bar, in the embodiment shown in the drawing, which is bridged between inside frame 5 and outside frame 4. However, the engaging member may be a rod, pipe, or the like.

Figure 8:
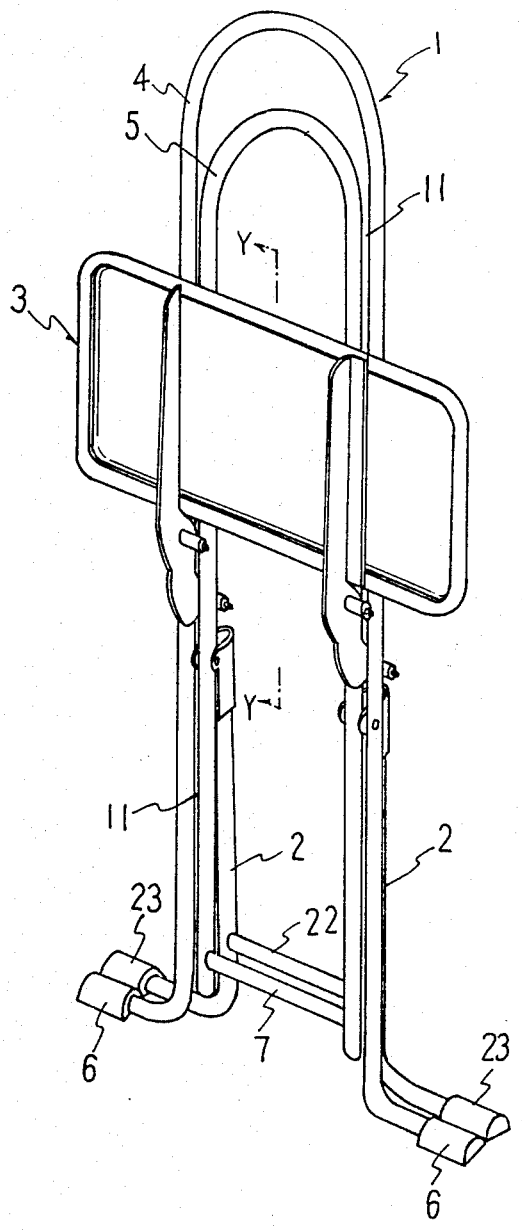
FIG. 8 is a perspective view showing the chair of FIG. 1 when it is folded.

After the seat 3 is folded, the rear leg 2 is also folded in an almost flat state, as shown in FIGS. 8 and 9.

When the above mentioned spacers 12 are tightly inserted between the connecting member 24 and the outside frame 4, the rear leg 2 can be also held with main frame 1 due to the friction force between the corresponding surfaces of the connecting member 24 and the frames 4 and 5. Therefore, it is convenient to carry the folded chair.

However, another means for fixing the rear leg 2 to the main frame 1 can be employed as required.

Though preferable embodiments of the present invention are described above with reference to accompanying drawings, it is to be understood that the present invention is not limited to the above-mentioned embodiments, and various changes and modifications may be made in the invention without departing from the spirit and scope thereof.

What we claim is:

1. A chair with a height-adjustable seat, comprising:

a main frame having substantially inverse-U shaped outside and inside frames, each of said outside and inside frames formed by a pipe, said inside frame being arranged and fixed to said outside frame so as to form parallel gaps at left and right sides of the inverse-U shaped frames, a predetermined portion of said parallel gaps serving as left and right guide portions arranged in a pair extending in an up-and-down direction parallel with each other; and a seat adapted to be movably connected to said guide portions, said seat having a width broader than a distance between said guide portions, said seat having left and right vertical plate supporting portions, each vertical plate supporting portion being inserted into one of said gaps, and being provided with a pair of bar-like rear stoppers perpendicularly and symmetrically aligned with respect to each of said supporting portions, respectively, and a pair of bar-like front stoppers perpendicularly and symmetrically aligned with respect to each of said vertical plate supporting portions, respectively, said rear stoppers and said front stoppers being situated between said pair of pipes, so that said rear stoppers abut against said pipes from a rear side thereof and said front stoppers abut against said pipes from a front side thereof in order to hold said seat in a substantially horizontal orientation;

a foldable rear leg having upper ends pivotally jointed to said main frame, a bar-like engaging member bridged between said outside and inside frames; and a slot for receiving said engaging member provided in said vertical plate supporting portions so as to receive said engaging member to lock said seat in an orientation turned toward said main frame.

* * * * *